US010791822B2

(12) United States Patent
Levy et al.

(10) Patent No.: US 10,791,822 B2
(45) Date of Patent: Oct. 6, 2020

(54) MULTI-HEAD ARTIST AND MAKE-UP BRUSH

(71) Applicants: Darren Levy, North Fort Myers, FL (US); Frank Levy, Fort Myers, FL (US)

(72) Inventors: Darren Levy, North Fort Myers, FL (US); Frank Levy, Fort Myers, FL (US)

( * ) Notice: Subject to any disclaimer, the term of this patent is extended or adjusted under 35 U.S.C. 154(b) by 0 days.

(21) Appl. No.: 15/851,941

(22) Filed: Dec. 22, 2017

(65) Prior Publication Data

US 2018/0116386 A1 May 3, 2018

Related U.S. Application Data

(63) Continuation of application No. 15/494,858, filed on Apr. 24, 2017, now Pat. No. 9,872,556, and a continuation of application No. 15/091,010, filed on Apr. 5, 2016, now Pat. No. 9,687,069, and a continuation of application No. 14/278,329, filed on (Continued)

(51) Int. Cl.

| | |
|---|---|
| ***G01N 1/00*** | (2006.01) |
| ***A46B 5/00*** | (2006.01) |
| ***A46B 15/00*** | (2006.01) |
| ***A46B 7/02*** | (2006.01) |
| ***A46B 7/04*** | (2006.01) |

(Continued)

(52) U.S. Cl.

CPC ..... *A46B 5/0095* (2013.01); *A45C 11/008* (2013.01); *A46B 7/023* (2013.01); *A46B 7/04* (2013.01); *A46B 15/0091* (2013.01); *A46B 17/065* (2013.01); *A45D 2200/205* (2013.01); *A45D 2200/25* (2013.01); *A46B 2200/1046* (2013.01); *A46B 2200/205* (2013.01)

(58) Field of Classification Search

CPC ..... A45D 33/28

See application file for complete search history.

(56) References Cited

U.S. PATENT DOCUMENTS

| | | | |
|---|---|---|---|
| 2,631,321 | A | 3/1953 | Mureau |
| 2,789,304 | A | 4/1957 | Leavin |

(Continued)

FOREIGN PATENT DOCUMENTS

| | | | |
|---|---|---|---|
| CN | 2879757 | Y | 3/2007 |
| CN | 102759810 | B | 12/2013 |
| WO | WO2008/155793 | A2 | 12/2008 |

*Primary Examiner* — Jyoti Nagpaul

(74) *Attorney, Agent, or Firm* — Welsh Flaxman & Gitler LLC

(57) ABSTRACT

A make-up brush system includes a mandrel having a first end and a second end. The first end includes a gripping surface for engagement with a hand of a make-up artist and the second end being shaped and dimensioned for selective engagement with a plurality of make-up brushes. A plurality of make-up brushes is provided. Each of the plurality of make-up brushes includes a first end and a second end, the first end including a functional component of the make-up brush and the second end including a coupling member shaped and dimensioned for selective engagement with the second end of the mandrel. The system also includes a case both supporting and sanitizing the various components of the present invention. The case includes a tray supporting the plurality of make-up brushes in accessible positions within the case.

1 Claim, 13 Drawing Sheets

Related U.S. Application Data

May 15, 2014, now Pat. No. 9,339,105, and a continuation-in-part of application No. 12/608,709, filed on Oct. 29, 2009, now abandoned, and a continuation-in-part of application No. 11/432,443, filed on May 11, 2006, now abandoned.

(51) Int. Cl.
*A45C 11/00* (2006.01)
*A46B 17/06* (2006.01)

(56) References Cited

U.S. PATENT DOCUMENTS 3,268,939 A 8/1966 Averse
3,426,768 A 2/1969 Vardaros
4,135,269 A 1/1979 Marston
4,567,905 A 2/1986 Stewart et al.
4,596,261 A 6/1986 Ronda et al.
5,109,877 A 5/1992 Takeda
5,160,699 A 11/1992 Siegal
5,586,653 A * 12/1996 Taveroff ..... A45D 40/24 132/295
5,815,877 A 10/1998 Heneveld
D401,419 S 11/1998 Hartmann et al.
5,926,903 A 7/1999 Kim
6,070,594 A 6/2000 Mears
6,070,597 A 6/2000 Motherhead
6,096,264 A 8/2000 Peifer
6,461,568 B1 10/2002 Eckhardt
6,821,355 B1 11/2004 Taylor et al.
6,895,624 B2 5/2005 Fischer et al.
7,162,802 B2 1/2007 Benardeau et al.
7,918,620 B2 4/2011 Del Ponte
8,074,666 B2 12/2011 Piao
8,132,285 B2 3/2012 Piao
8,158,961 B2 4/2012 Merkle
8,481,970 B2 7/2013 Cooper et al.
8,770,209 B2 * 7/2014 Kim ..... A45D 33/26 132/294
8,964,405 B2 2/2015 LaPorte et al.
9,011,031 B2 4/2015 Piao
9,339,576 B2 5/2016 LaPorte et al.
2003/0034459 A1 2/2003 Bonin
2004/0168700 A1 * 9/2004 Dorf ..... A45C 11/008 132/313
2005/0000850 A1 1/2005 Young
2006/0175554 A1 8/2006 Riddell

* cited by examiner

MULTI-HEAD ARTIST AND MAKE-UP BRUSH

CROSS REFERENCE TO RELATED APPLICATIONS

This application is a continuation of U.S. patent application Ser. No. 15/494,858, entitled "MULTI-HEAD ARTIST AND MAKE-UP BRUSH," filed Apr. 24, 2017, which is currently pending, which is a continuation of U.S. patent application Ser. No. 15/091,010, entitled "MULTI-HEAD ARTIST AND MAKE-UP BRUSH," filed Apr. 5, 2016, which is now U.S. Pat. No. 9,687,069, which is a continuation of U.S. patent application Ser. No. 14/278,329, entitled "MULTI-HEAD ARTIST AND MAKE-UP BRUSH," filed May 15, 2014, which is now U.S. Pat. No. 9,339,105, which is a continuation-in-part of U.S. patent application Ser. No. 12/608,709, entitled "MULTI-HEAD ARTIST AND MAKE-UP BRUSH," filed Oct. 29, 2009, which is abandoned, which is a continuation-in-part of U.S. patent application Ser. No. 11/432,443, entitled "MULTI-HEAD ARTIST AND MAKE-UP BRUSH," filed May 11, 2006, which is abandoned, the disclosures of which are incorporated herein by reference in their entirety.

BACKGROUND OF THE INVENTION

1. Field of the Invention

The present invention relates generally to an artist/make-up brush device, and more specifically to a brush device that consists of a pen-type cylinder with an individual brush tip, wherein the brush tip is selectively interchangeable, retractable and sanitizable.

2. Description of the Related Art

Prior brushes have tried to address the problem of both utilizing retractable bristles to address self-styling and concerns regarding interchangeability with limited success. Some prior retractable bristle brushes utilize complicated systems of movement that increase the cost of manufacture of the brush, require two hands to operate effectively, and fail due to material collected within the operating components of the brush.

One example of a retractable bristle brush is disclosed in U.S. Pat. No. 5,815,877 to Heneveld. Heneveld provides a rectangular brush wherein bristles are retracted from the top side of the brush by moving a sleeve that holds the bristles along a bottom side of the brush, retracting the bristles into the brush handle.

Several prior art brushes provide circular bristle sections that require extensive mechanical systems and movement to retract and/or extend the bristles. U.S. Pat. No. 6,070,594 to Mears discloses a circular brush having bristles mounted on rotatable axles, which are then moveably mounted on an inner mandrel with the bristles extending through slots through an outer mandrel rotatably mounted on the brush. The system requires a user to rotate the inner mandrel in relation to the outer mandrel while maintaining the brush in a styling position to retract the bristles.

U.S. Pat. No. 4,596,261 to Renda et al. discloses a complicated system utilizing cams and grooves, and includes several control mechanisms to retract and extend the bristles. The brush as disclosed does not provide for one-handed use in styling one's hair.

U.S. Pat. No. 4,567,905 to Stewart et al. discloses another version of a cam operated slidable retractable bristle brush. The bristle retraction control operates by co-action with a rotatable cylindrical mandrel having pivotal bristles.

U.S. Pat. No. 5,109,877 is retractable and has multiple brush tips contained within a single unit. This configuration has several drawbacks to the make-up artist. First, it has a relatively large diameter which makes it less desirable to a make-up artist. Second, the multiple tips that retract into a single unit have the potential for mixture of particulates from the different brush heads.

The prior devices, as described above, have several problems. Some can only accommodate a single brush stick. When more than one brush stick is used selectively, the changing either cannot be accomplished rapidly, or the change results in a undesirable mixing of particulate from the various brush heads.

It is thus desired to provide a replaceable brush that has a streamlined body wherein the artist may rapidly use.

SUMMARY OF THE INVENTION

The subject invention solves the above problems by offering a make-up brush device including a pen-type cylindrical container capable of accommodating a brush head having a quick connect/disconnect that allow the user to quickly and easily change brush heads with a single handed motion for particular needs or purposes.

The brush device according to the present invention generally includes a cylindrical casing, usually in the shape of a pen.

In one embodiment, the brush device of the present invention comprises: (a) a cylindrical casing having an orifice in a head end and a closed rear end; and (b) a retractable mandrel positioned within the cylindrical casing extending longitudinally in the cylindrical casing; wherein the mandrel is slidably mounted in the casing, the mandrel further comprising a means for controlling mandrel extension between an open position wherein the bristles extend through the orifice and a closed position wherein the bristles are retracted to a position within the cylindrical casing. The sliding track uses a Track Initiating Divot (TID) at the proximal and distal ends respectively of the sliding track. This is to lock the mandrel into the open and closed positions. A make-up brush tip is mounted on the mandrel whereby the make-up brush tip is positioned for axial sliding movement therein.

The brush device described may be configured for use by artists and for make-up (i.e., cosmetic) applications.

The brush device of the present invention weighs less than about 10 grams. In one embodiment, the make-up brush device of the present invention weighs less than about 8 grams. In a preferred embodiment, the make-up brush device of the present invention weighs between about 6-8 grams.

The brush device comprises a make-up brush tip mounted on the end of a mandrel. The tip and mandrel further comprise opposing quick connect/disconnect means. This allows the user to quickly and easily change make-up brush tips while utilizing a single handle. In one embodiment, the quick connect/disconnect is achieved through using a single magnet on the mandrel which meets with a metal attraction plate on the proximal end of each retractable tip.

The brush device cylindrical casing comprises a plurality of ridges on the surface interacting with an interlock means attached to the mandrel as a means of moving the mandrel. There is an interlock means that secures the mandrel into a fixed position.

In one embodiment, the brush device comprises a single mandrel.

The mandrel has an interlock connected thereto as a control and interlock means wherein the interlock extends from the surface of the mandrel and extends outward through the surface of the cylinder. The sliding track uses a Track Initiating Divot and a Track Terminating Divot at the proximal and distal ends respectively of the sliding track. This is to lock the mandrel into the open and closed positions.

Further contemplated is a method for applying make-up comprising the steps of: (a) selecting a first desired brush tip; (b) extending a mandrel from a retractable brush device to receive a brush tip; (c) securing the selected brush tip to a brush device with quick connect/disconnect using a single magnet on the mandrel which meets with a metal attraction plate on the proximal end of each retractable tip; (d) using the brush device with the brush tip secured to apply a first make-up; (e) removing the first brush tip by disengaging the brush tip by a quick connect/disconnect; (f) selecting a second brush tip; (g) securing the second brush tip to a device by means of a quick connect/disconnect; (h) retracting the second brush tip into a device with a retractable means for retracting the brush tip within a casing.

The invention also includes a brush kit comprising: (a) a device for holding brush tips, wherein the device comprises means for exposing, retracting, and storing a single removable brush tip; (b) a plurality of brush tips, wherein each brush tip may be quickly attached and detached from a holder through use of a quick connect/disconnect; (c) a case for containing the device and the brush tips, the case having a base and a cover, the case having an ultra violet light source with electronic board, battery source, and a timer switch placed on the inside a cover of the case and the base and cover of the case are constructed and arranged such that when the case is closed, the ultraviolet light turns on and sanitizes brush tip bristles placed thereon. The light further is controlled by a timer switch incorporated into the electronic board such that the ultraviolet light illuminates for a preset period of time up to five minutes and the light automatically switches off when sanitization is complete.

It is an object of the present invention to provide a retractable brush with easily replaceable brush tips.

It is another object of the present invention to provide a retractable brush with easily replaceable brush tips usable by artists.

It is another object of the present invention to provide a retractable brush with easily replaceable brush tips usable for application of make-up.

It is another object of the present invention to provide a retractable brush with easily replaceable brush tips whereby the brush tips are changed with a quick connect/disconnect.

It is another object of the present invention to provide a retractable brush with easily replaceable brush tips whereby the quick connect/disconnect is achieved through use of opposing polarity magnets.

It is further an object of the present invention to provide a make-up brush system including a mandrel having a first end and a second end. The first end includes a gripping surface for engagement with a hand of a make-up artist and the second end being shaped and dimensioned for selective engagement with a plurality of make-up brushes. A plurality of make-up brushes is provided. Each of the plurality of make-up brushes includes a first end and a second end, the first end including a functional component of the make-up brush and the second end including a coupling member shaped and dimensioned for selective engagement with the second end of the mandrel. The system also includes a case both supporting and sanitizing the various components of the present invention. The case includes a tray supporting the plurality of make-up brushes in accessible positions within the case.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Referring to the various figures, the present invention is described in detail by referring to several preferred embodiments thereof that are shown in the accompanying drawings. It should be understood that those embodiments are only shown specifically, but they are non-limiting as far as they don't depart from the spirit and scope of the invention, as defined in the appended claims.

Figure 1:
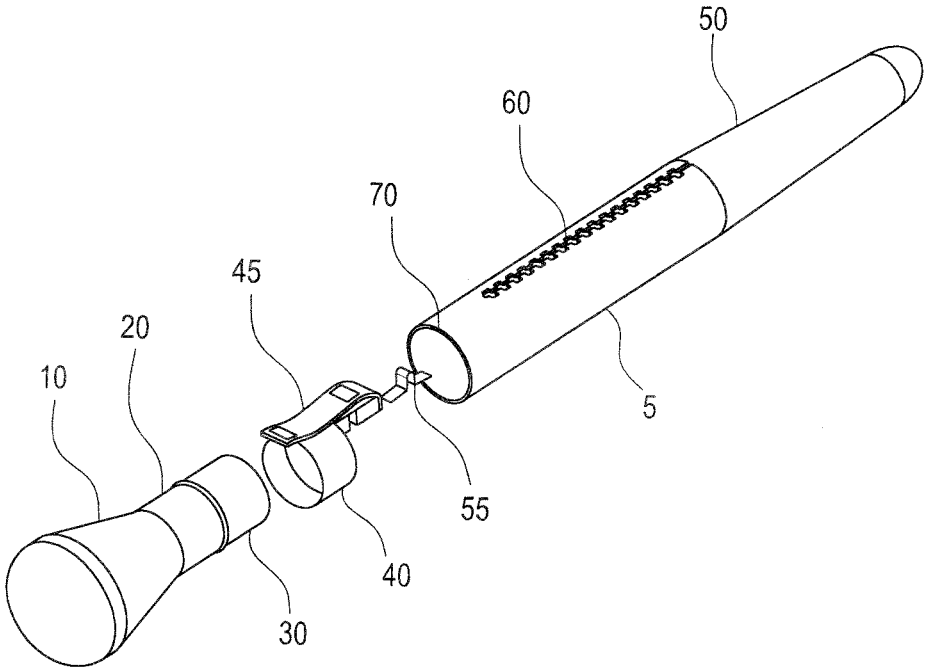
FIG. 1 shows the separated components of the brush device.

As used herein, the term mandrel is the shaft on which the working tool, in this invention the brush tip, is mounted In FIG. 1, the device 5 is shown in a disassembled manner to demonstrate the component parts. The brush bristles 10 are secured into bristle housing 20. The bristle housing 20 is connected to brush tip 30. Brush tip 30 is configured such that the end to be fastened is paired with an appropriate receiving portion of mandrel 40. The brush tip 30 and receiving portion 40 act in concert to create a quick connect/disconnect. The specific manner of quick connect/disconnect may be any manner known in the art by which the component may be securely fastened and subsequently unfastened in order for the user to change brush tips as desired. The mandrel 40 has attached an interlock 45. Underneath interlock 45 is a tension applicator 55. Tension applicator 55 exerts force away from mandrel 40 such that when interlock 45 is placed in between axial parallel portions 60, it serves to lock interlock 45 into a fixed position. The fixed position may be with mandrel 40 extended, such that bristles 10 extend outward from cylindrical casing 50 through orifice 70.

Figure 2:
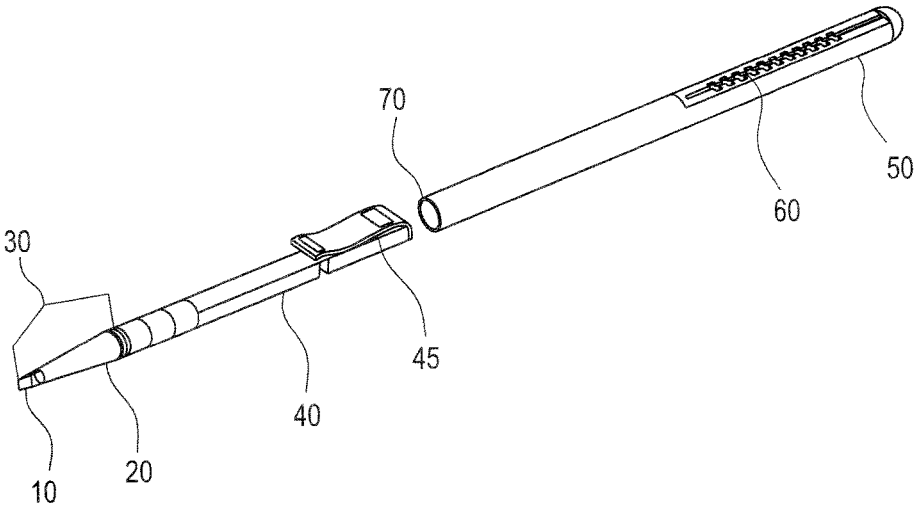
FIG. 2 shows the separated components showing the mandrel separated from the cylindrical casing.

FIG. 2 shows the device 5 in a disassembled manner to demonstrate the component parts. This view shows a smaller bristle 10, secured into bristle housing 20. In this view, brush assembly 30 is connected to mandrel 40. The assembly is attached by a quick connect/disconnect. The quick connect disconnect may be by any acceptable means. The embodiment shown herein shows the attachment of brush assembly 30 connected to mandrel 40.

Although not shown in the figure, in this particular embodiment brush assembly 30 is held in place to mandrel 40 using a single magnet 80 on mandrel 40 which meets with a metal attraction plate 85 on the proximal end of each retractable tip 30. This entire portion is placed in cylindrical casing 50.

Figure 3:
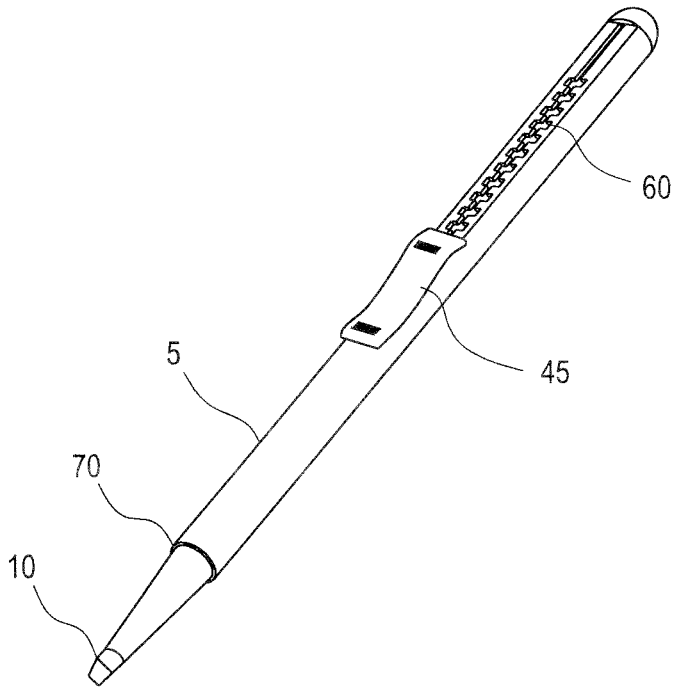
FIG. 3 shows an assembled embodiment of the device wherein the mandrel is extended and the brush tip extends from the orifice of the cylindrical casing.

FIG. 3 shows the device 5 in an assembled manner. In this view, the interaction between interlock 45 and axial parallel portions 60 is seen. The interlock will rest in the spaces created by portions 60 such that it will lock the mandrel into place. This view shows the bristles and tips 10 protruding from the device 5 through orifice 70.

Figure 4:
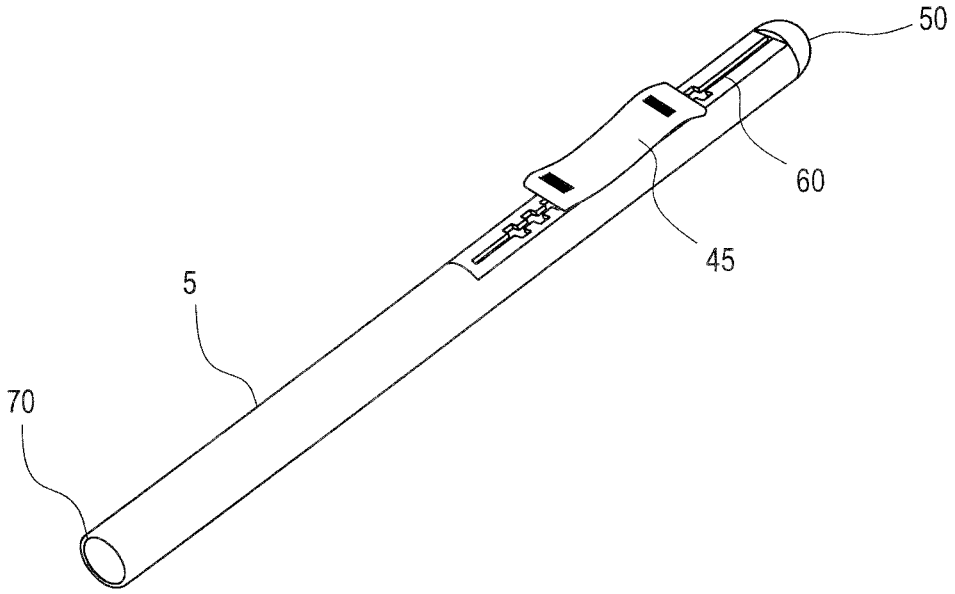
FIG. 4 shows an assembled embodiment of the device wherein the mandrel is retracted and the brush tip is completely within the cylindrical casing.

FIG. 4 shows the device 5 in an assembled manner. This view depicts the device of the present invention wherein the mandrel is locked in a position such that the bristles and tip are retracted and contained within the cylindrical casing 50 of the device.

Figure 5:
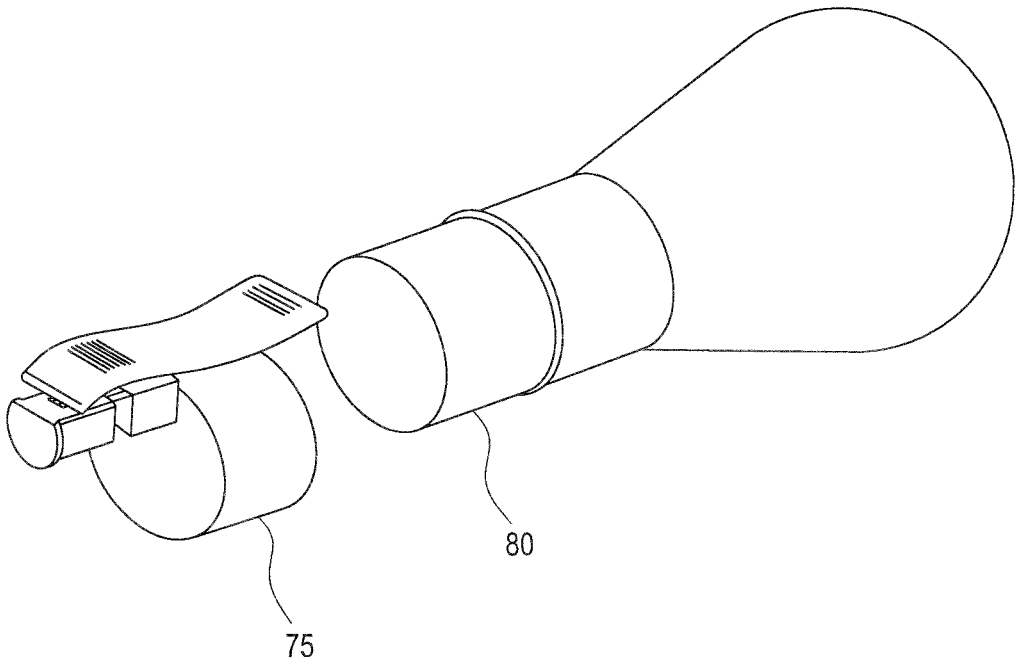
FIG. 5 shows an embodiment of the mandrel and tip.

FIG. 5 shows a rear perspective view wherein brush tip 80 is separated from mandrel 75.

Figure 6:
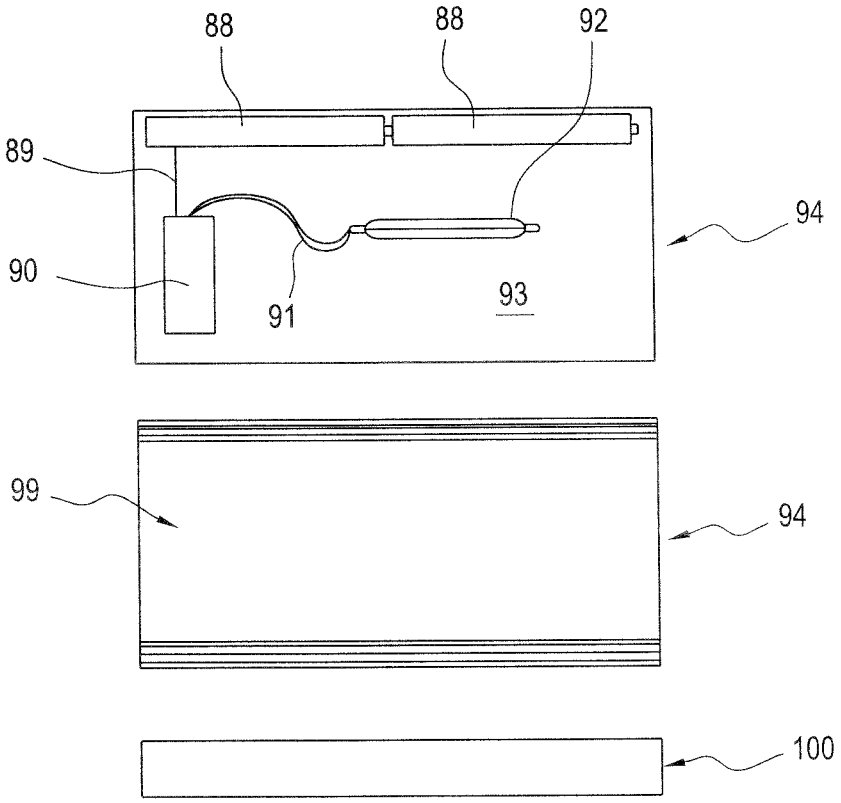
FIG. 6 is a case of the present invention showing the inside cover, outside cover and front view of the closed case.
Figure 7:
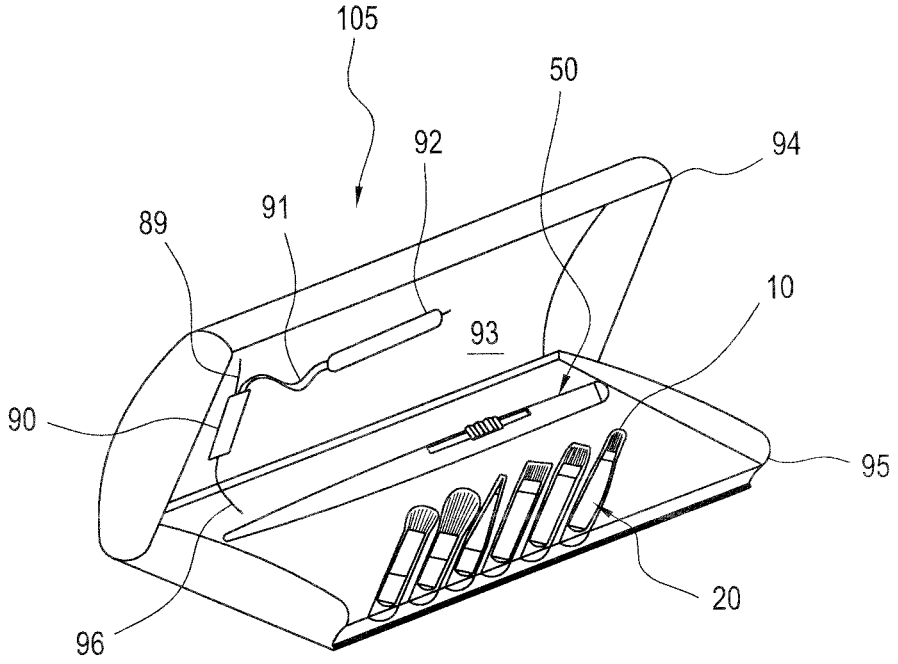
FIG. 7 is a perspective view of the open case of the present invention showing brushes placed on the base of the case and an ultraviolet light attached to the inside cover.

As seen in FIGS. 6 and 7, case 105 has a cover 94 and a base 95. Cover 94 has an outer surface 99 and an interior surface 93. The interior surface 93 has batteries 88, electronic circuit board 90 and ultraviolet light 93 incorporated thereon and secured into position. Circuit board 90 has power wires 89 supplying power from batteries 88. Circuit board 90 has supply wires 91 that supply power to ultraviolet light 92. Actuator 96 transmits a signal to circuit board 90 when cover 94 is closed upon base 95. The signal initiates power from circuit board 90 to ultraviolet light 92 for a preset period. In a preferred embodiment, ultraviolet light is illuminated for 5 minutes.

Figure 8:
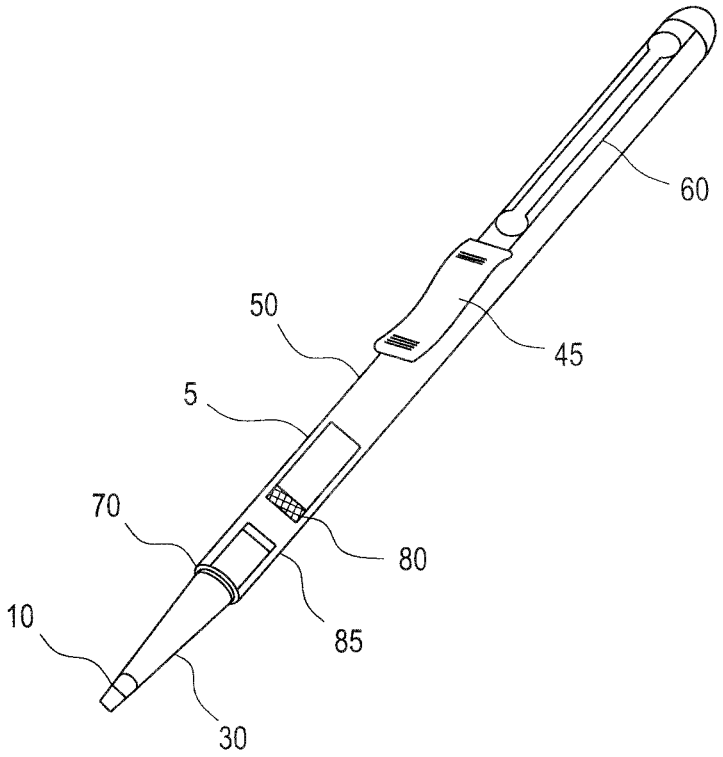
FIG. 8 shows an embodiment of a brush tip with a single polarity magnet and metal attraction plate.
Figures 9, 10:
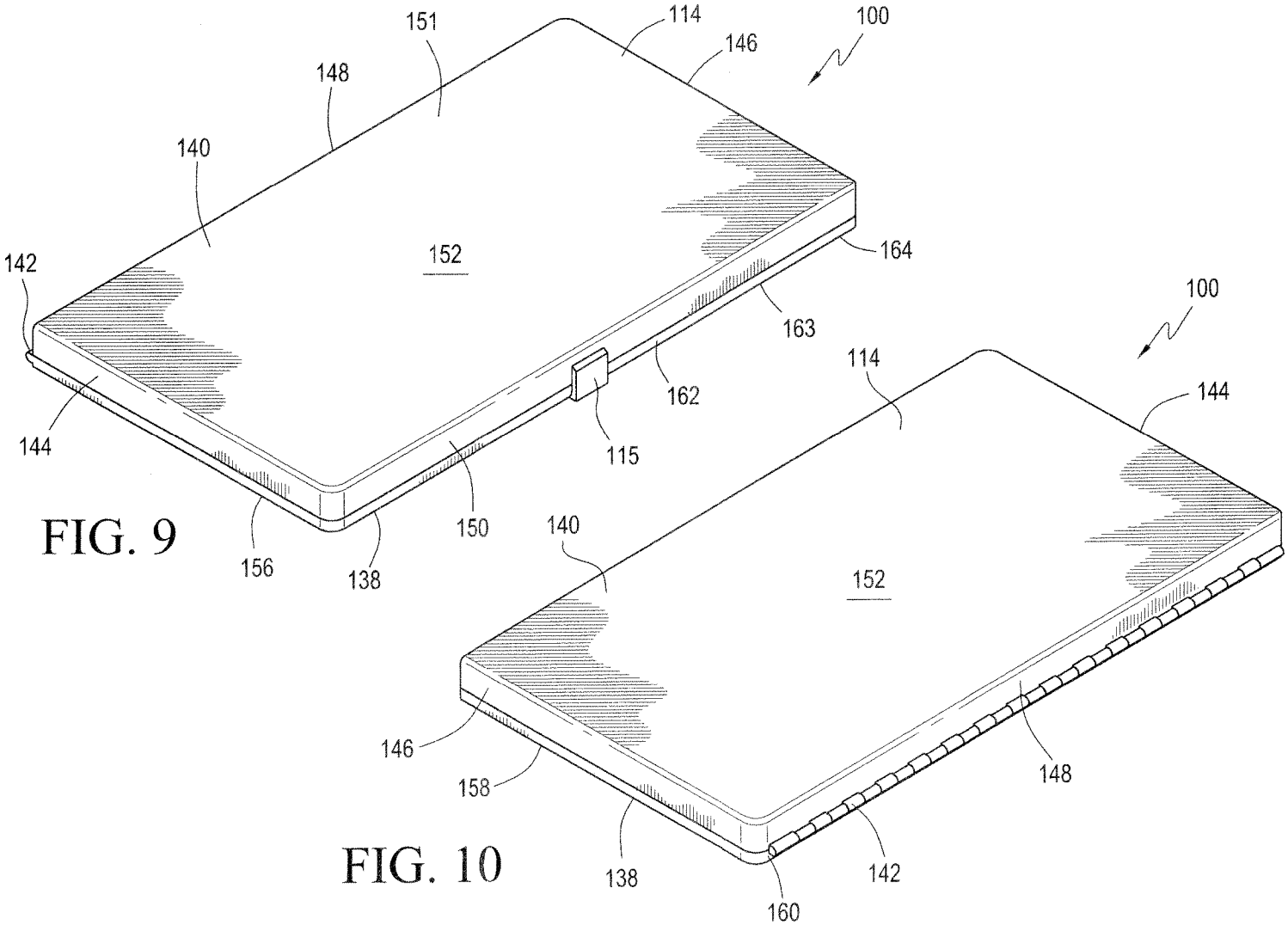
FIG. 9 is a top perspective view of a closed case in accordance with an alternate embodiment of the present invention.
FIG. 10 is a bottom perspective view of the case shown in FIG. 9.
Figure 11:
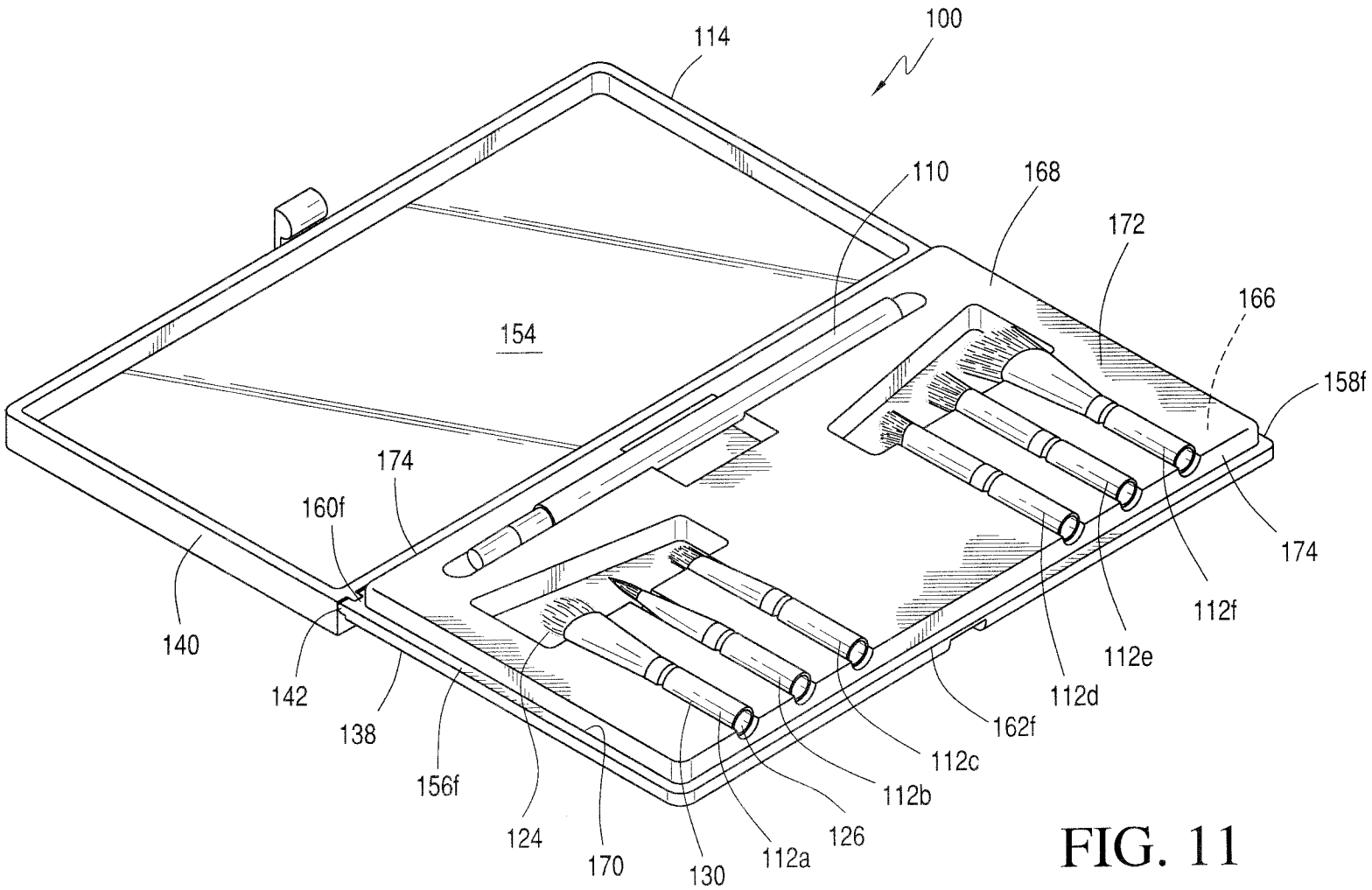
FIG. 11 is a perspective view of the case shown in FIG. 9 when it is opened.
Figure 12:
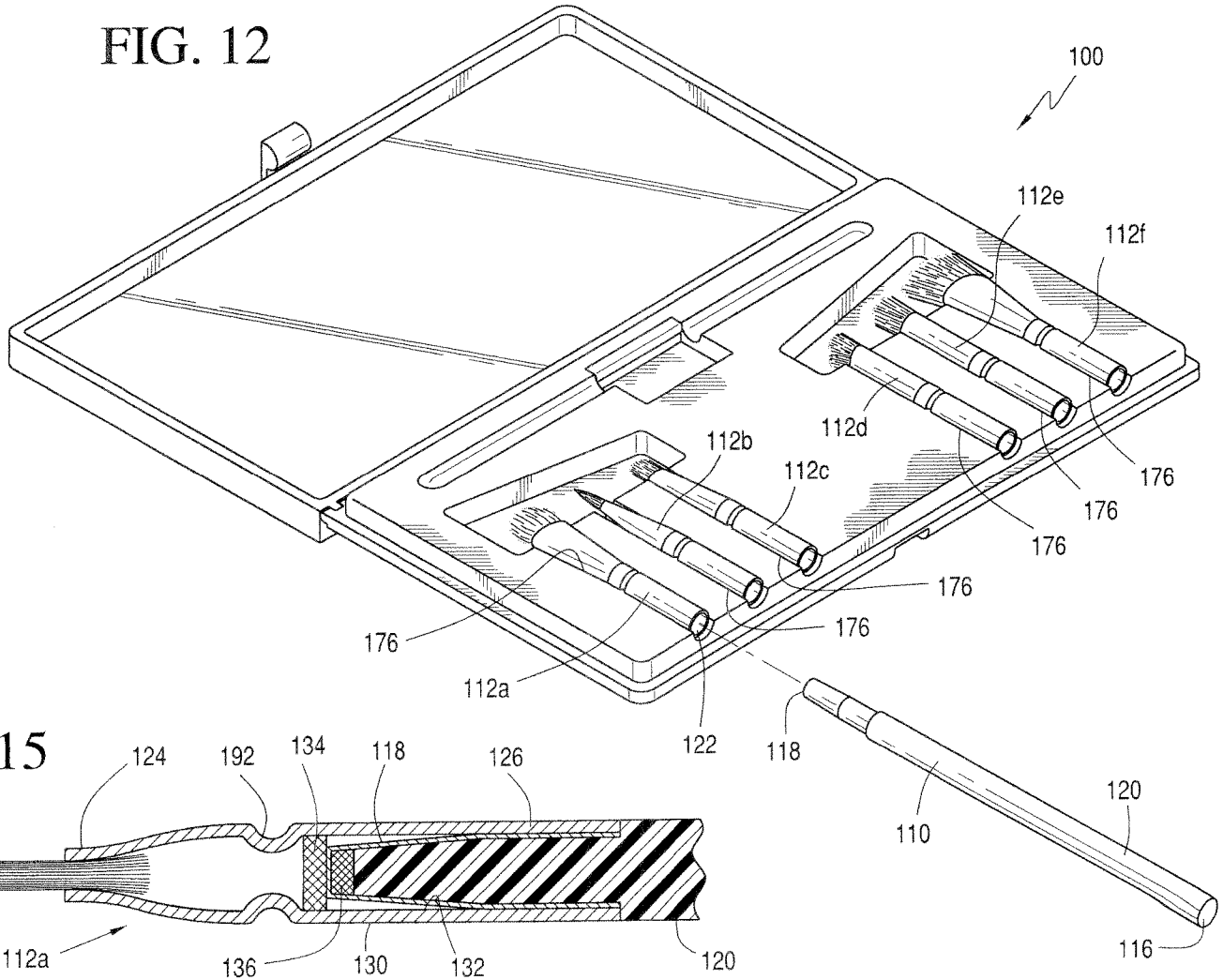
FIGS. 12-14 are perspective views showing coupling of a brush with a mandrel in accordance with the embodiment disclosed with reference to FIG. 9.
Figure 15:
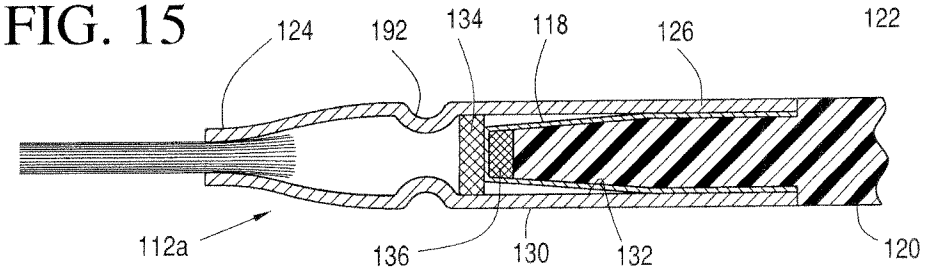
FIG. 15 is a cross sectional view of a mandrel coupled to a brush in accordance with the embodiment disclosed with reference to FIG. 9.
Figures 13, 14:
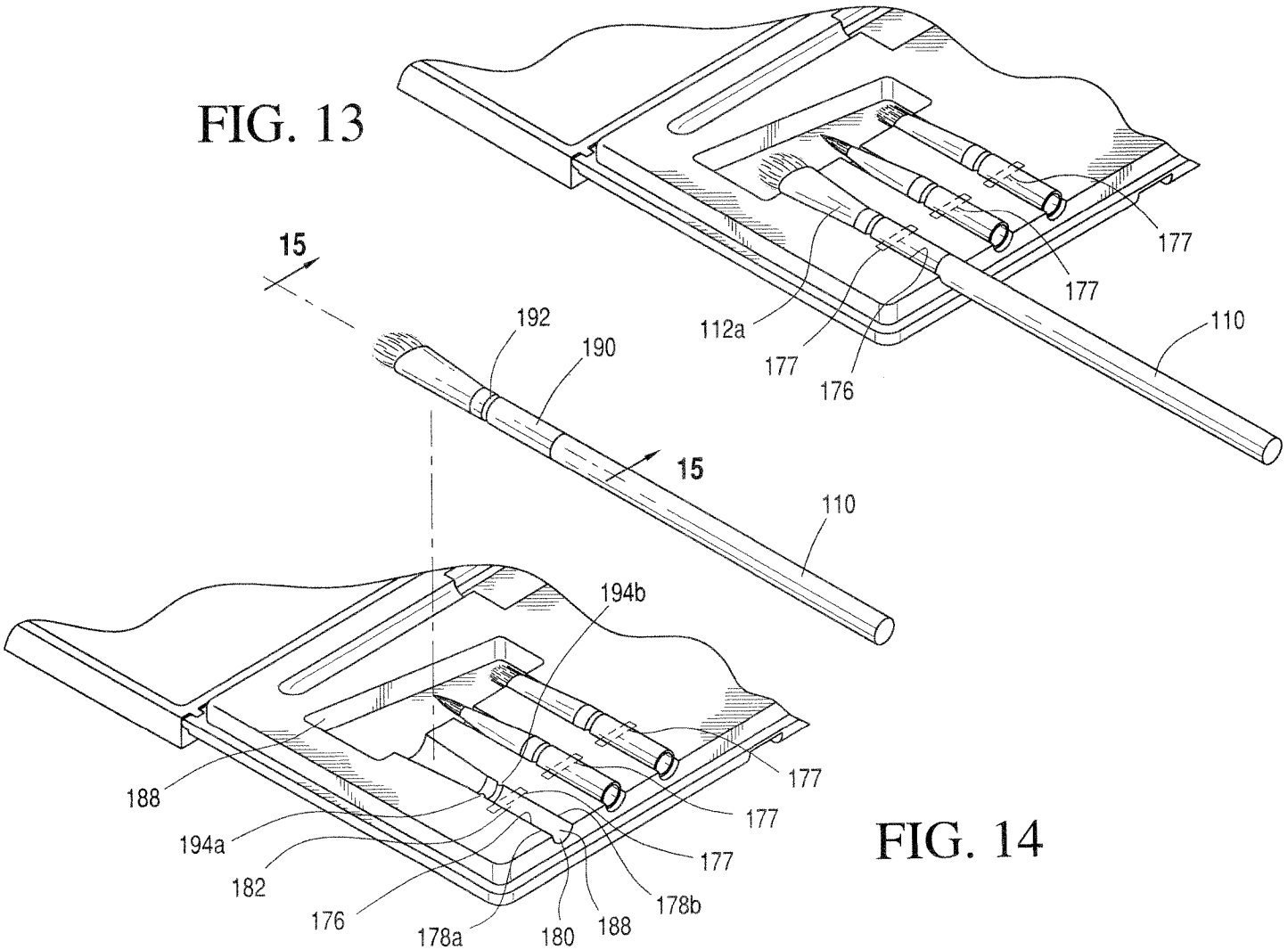
Figure 16:
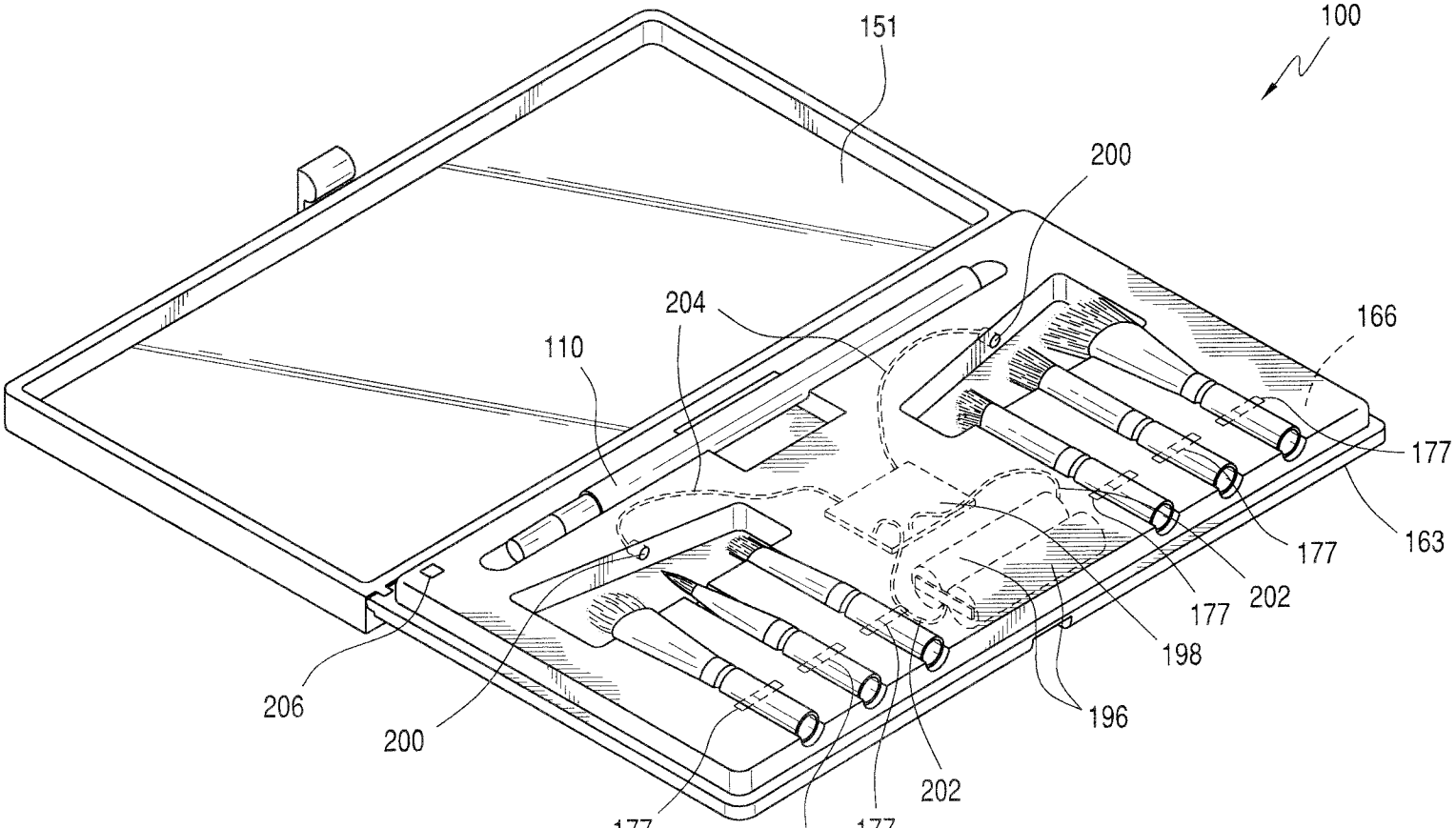
FIG. 16 is a perspective view of the case shown in FIG. 9 when it is opened and with the sanitizing elements shown in phantom lines.

In one embodiment, as seen in FIG. 8, a single polarity magnet 80 connects to a metal attraction plate 85 that is on one end of brush tip 30. Brush tip 30 extends through orifice 70.

It is contemplated that the present invention be part of a kit. Both novice and professional make-up artists may use the invention. Additionally, artists will be able to exchange paintbrush tips with the present invention. The user will be able to select brush tips that will quickly and easily attach to the mandrel on the subject invention. The contemplated brush tips would include any of the make-up applications commonly known.

Unlike prior attempts at multi-tip brush devices, the present invention will be streamlined and will not be particularly cumbersome as devices that contain multiple attached brushes. It is known in the art that heavy brushes do not balance well in the hand of the make-up artist, and do not allow for maximum detail dexterity.

In accordance with another embodiment of the present invention, and with reference to FIGS. 9-16, a make-up brush system 100 in accordance with an alternate embodiment is disclosed. The present system is composed of a mandrel 110, a plurality of brushes (and other make-up tools) 112*a-f*, and a case 114 both supporting and sanitizing the various components of the present invention.

The mandrel 110 is generally an elongated member shaped and dimensioned for comfortable handling by a make-up art or an individual applying make-up to himself/herself. As such, the mandrel 110 includes a first end 116 and a second end 118. The first end 116 includes a gripping surface 120 for engagement with the hand of the make-up artist. The second end 118 of the mandrel 110 is shaped and dimensioned for selective engagement with the plurality of make-up brushes 112*a-f* (see FIG. 15). With this in mind, the second end 118 of the mandrel 110 is an elongated narrow member shaped and dimensioned for coupling with the second end 122 of each of the plurality of make-up brushes 112*a-f*.

As discussed above, the present make-up brush system 100 provides for the convenient use of a plurality of different make-up brushes 112*a-f*. It is appreciated a plurality of such brushes are known in the art. In accordance with a preferred embodiment, the make-up brushes 112*a-f* used in accordance with a preferred embodiment of the present invention are selected from the group consisting of any animal hair, any synthetic hair, and man-made fiber and foam product.

Each of the make-up brushes 112*a-f* making up the plurality of make-up brushes used in the present make-up brush system 100 includes a first end 124 and a second end 126. The first end 124 includes, what may be thought of as, the functional component of the make-up brush 112*a-f*. For example, and with reference to make-up brush 112*a*, the first end 124 includes brush bristles 128 as discussed above with regard to the prior embodiments. The second end 126 of each of the plurality of make-up brushes 112*a-f* includes an identical coupling member 130, that is, the brush tip as discussed above with regard to the prior embodiments, shaped and dimensioned for selective engagement with the second end 118 of the mandrel 110.

With this in mind, the coupling member 130 at the second end 126 of each of the plurality of make-up bushes 112*a-f* includes a coupling recess 132 shaped and dimensioned for receiving the second end 118 of the mandrel 110 in a mating configuration. Secure coupling of the make-up brushes 112*a-f* and the mandrel 110 is facilitated by the provision of interacting metal shim 134 on the second end 126 of the make-up brushes 112*a-f* and a magnetic member 136 on the second end 118 of the mandrel 110. The metal shim 134 and the magnetic member 136 produce a relatively low strength attraction but will provide sufficient attractive force to maintain each of the make-up brushes 112*a-f* and the mandrel 110 in a coupled arrangement during normal usage, while similarly allowing disconnection in the manner discussed below.

In addition to the mandrel 110 and the plurality of make-up brushes 112*a-f*, the present make-up brush system 100 includes a case 114 providing for the sanitizing of the various functional elements of the present make-up brush system 100 and for the convenient exchange of the plurality of make-up brushes 112*a-f* upon the second end 118 of the mandrel 110.

The case 114 includes a base 138 and a cover 140. The base 138 and cover 140 are connected by a hinge 142 allowing for the cover 140 to move between an open configuration where the contents of the case 114 are exposed and a closed configuration where the contents of the case 114 are fully enclosed within the case 114.

In particular, the cover 140 is substantially rectangular in shape and includes first and second short side walls 144, 146 and first and second long side walls 148, 150 depending from the cover wall 151, as well as an external surface 152 and an interior surface 154 on opposite sides of the cover wall 151. Similarly, the base 138 is substantially the same shape as the cover 140 and is therefore rectangular in shape and includes first and second short side walls 156, 158 and first and second long side walls 160, 162 depending from the base wall 163, as well as an external surface 164 and an interior surface 166 on opposite sides of the base wall 163. When in the closed configuration the short side walls 144, 146 and long side walls 148, 150 of the cover 140 align with the short side walls 156, 158 and long side walls 160, 162 of the base 138 with the respective external surfaces 152, 164 of the cover wall 151 and the base wall 163 facing away from each other.

As briefly discussed above, a hinge 142 connects the base 138 to cover 140. In accordance with a preferred embodiment, the hinge 142 is formed between the first long side wall 148 of the case 114 and the first long side wall 160 of the base 138. In this way, the first long side wall 148 of the case 114 and the first long side wall 160 of the base 138 are held adjacent to each other as the case 114 is moved between its open configuration and its closed configuration. The second long side wall 150 of the case 114 and the second long side wall 162 of the base 138 are, in contrast, permitted to move toward and away from each other as the case 114 moves between its closed configuration where the second long side wall 150 of the case 114 and the second long side wall 162 of the base 138 are in contact such that the interior contents of the case 114 are hidden therein and the open configuration where the second long side wall 150 of the case 114 and the second long side wall 162 of the base 138 are spaced from each other allowing the make-up artist access to the contents of the case 114. The case 114 is further provided with a clasp 115 allowing for selective fastening of the case 114 in a closed configuration and opening thereof when desired.

Access to the make-up brushes 112*a-f* held within the case 114 is achieved by providing a tray 168 within the base 138 for supporting the plurality of make-up brushes 112*a-f* in accessible positions within the case 114. The tray 168 sits within the interior space 170 of the base 138 as defined by the interior surface 166, the first and second long side walls 160, 162, and the first and second short side walls 156, 158.

With this in mind, the tray 168 includes an upper support surface 172 and downwardly extending appendages 174 which are positioned adjacent the first and second long side walls 160, 162, and the first and second short side walls 156, 158 such that the support surface 172 sits above the free edges 156*f*, 158*f*, 160*f*, 162*f* of the respective first and second long side walls 160, 162 and the first and second short side walls 156, 158. In this way, and as will be appreciated based upon the following detailed discussion, the mandrel 110 may be moved into position relative to the base 138 for selective engagement with the plurality of make-up brushes 112*a-f*.

The upper support surface 172 of the tray 168 includes a plurality of retention recesses 176 shaped and dimensioned for receiving and supporting a particular make-up brush 112*a-f*. Each of the retention recesses 176 is shaped and dimensioned to frictionally hold a make-up brush 112*a-f* and release the same when adequate force is applied. As all of the retention recesses 176 are functionally identical, with minor variations to accommodate various shapes of the make-up brushes 112*a-f*, a representative retention recess 176 is described below.

The retention recess 176 includes opposed side walls 178*a*, 178*b* and a base wall 180 connecting the opposed side walls 178*a*, 178*b*. The opposed side walls 178*a*, 178*b* and base wall 180 define a cavity 182 shaped and dimensioned for receiving a make-up brush 112*a-f*. While the front end 184 of the retention recess 176 is closed by a front wall 186, the rear end 188 of the retention recess 176 is open for the passage of the second end 118 of the mandrel 110 into the retention recess 176, and ultimately into the coupling member 130 at the second end 126 of the make-up brush 112*a-f*.

Retention of the make-up brushes 112*a-f* within the tray 168 for both removal and return of the make-up brushes 112*a-f* is achieved by the provision of a selective coupling mechanism between the make-up brushes 112*a-f* and the retention recess 176. In particular, between the first end 124 and the second end 126 of each make-up brush 112*a-f* is provided a brush body 190. The brush body 190 includes a circumferentially coupling recess 192 extending about the center thereof.

Similarly, each of the retention recesses 176, between the front end 184 thereof and the rear end 188 thereof, includes coupling detents 194*a*, 194*b* respectively extending from the opposed side walls 178*a*, 178*b* of the retention recess 176. The coupling detents 194*a*, 194*b* are of a size to fit within the circumferential coupling recess 192 of the brush body 190.

The interaction between the coupling detents 194*a*, 194*b* and the circumferential coupling recess 192 allows for selective retrieval and return of the make-up brushes 112*a-f* with only a single hand. Retrieval and return, as well as retention within the retention recesses 176, are facilitated by the integration of a magnet 177 into each of the retention recesses 176 (preferably along the underside of the tray and thereby hidden from view) in the area of the metal shim 134 of the brushes 112*a-f* (see FIGS. 13, 14 and 16). The magnets 177 are of a strength sufficient to hold the brushes 112*a-f* within the retention recesses 176 but allow for retrieval as described below.

In particular, and assuming the second end 118 of the mandrel 110 is free of any make-up brushes 112*a-f* and the plurality of make-up brushes 112*a-f* are sitting within their respective retention recesses 176 within the tray 168 of the case 114 with the metal shims 134 of the make-up brushes 112*a-f* engaged with the magnets 177 of the retention recesses 176, the second end 118 of the mandrel 110 is positioned in alignment with the rear end 188 of a retention recess 176 in which a desired make-up brush 112*a-f* is sitting. The second end 118 of the mandrel 110 is then moved toward the second end 126 of the make-up brush 112*a-f* and within the coupling member 130 thereof. With the mutual attraction of the metal shims 134 in the second ends 126 of the make-up brush 112*a-f* and magnetic member 136 in the second end 118 of the mandrel 110, the mandrel 110 is now coupled with make-up brush 112*a-f*.

However, the interaction between the circumferential coupling recess 192 of the brush body 190 and the coupling detents 194*a*, 194*b* prevents the make-up artist from simply pulling the make-up brush 112*a-f* rearward out the rear end 188 of the retention recess 176 along a line of force substantially parallel to the plane in which the upper support surface 172 of the tray 168 sits. The make-up brush 112*a-f* is, however, able to move upwardly away from the upper support surface 172 of the tray 168 in a direction substantially perpendicular to the plane in which the upper support surface 172 of the tray 168 lies, and away from the magnetic attraction between the magnetic 177 in the retention recesses 176 and the metal shim 134 of the make-up brush 112*a-f*.

With the make-up brush 112*a-f* coupled to the mandrel 110 and removed from the case 114 for use as the make-up artist sees fit, the make-up brush 112*a-f* may be used until such a time that the make-up artist, or lay-person, desires to return the make-up brush 112*a-f* to the case 114 (because the job is finished or because the make-up artist wishes to use a different make-up brush). When it comes time to return the make-up brush 112*a-f* to its retention recess, the circumferential coupling recess 192 of the brush body 190 and the coupling detents 194*a*, 194*b* once again prevent the make-up artist from simply pushing the make-up brush 112*a-f* forward into the rear end 188 of the retention recess 176 along a line of force substantially parallel to the plane in which the upper support surface 172 of the tray 168 sits. Rather, the make-up brush 112*a-f* is moved in the reverse direction of how it was removed, that is, the make-up brush 112*a-f* and the mandrel 110 are moved downwardly toward the upper support surface 172 of the tray 168 in a direction substantially perpendicular to the plane in which the upper support surface 172 of the tray 168 lies such that the circumferential coupling recess 192 of the brush body 190 and the coupling detents 194*a*, 194*b* align. Once in this position, the magnetic attraction between the magnets 177 into each of the retention recesses 176 and the metal shim 134 of the make-up brushes 112*a-f* help to hold the make-up brushes 112*a-f* within the retention recesses 176

With the circumferential coupling recess 192 of the brush body 190 and the coupling detents 194*a*, 194*b* aligned and the make-up brush 112*a-f* sitting within the retention recess 176, the make-up art may remove the mandrel 110 from the make-up brush 112*a-f* by pulling rearward with sufficient force to overcome the magnetic attraction of the magnetic member 136 at the second end 118 of the mandrel 110 and the metal shim 134 at the second end 126 of the make-up brush 112*a-f*. It is appreciated, the interaction between the circumferential coupling recess 192 of the brush body 190 and the coupling detents 194*a*, 194*b* of the retention recess 176 prevent removal of the make-up brush 112*a-f* when the make-up artist pulls rearward to remove the mandrel 110 from the make-up brush 112*a-f*.

In addition to providing for the support and retrieval of the make-up brushes 112*a-f*, the case 114 also provides for sanitizing of the various functional components. An interior surface 154, 166 of the cover wall 151 or the base wall 163 (in accordance with a disclosed embodiment it is the base 138) is provided with batteries 196, an electronic circuit board 198 and an ultraviolet light 200. The circuit board 198 has power wires 202 supplying power from the batteries 196. The circuit board 198 also has supply wires 204 that supply power to the ultraviolet light 200. An actuator 206 is linked to the base 138 and cover 140 such that the actuator 206 transmits a signal to circuit board 198 when the cover 140 is closed upon base 138. The signal initiates power from the circuit board 198 to the ultraviolet light 200 for a preset period. In a preferred embodiment, ultraviolet light is illuminated for 2-5 minutes.

In accordance with a preferred embodiment, the ultraviolet light 200 functions with the following characteristics:

Wattage: 0.3 W±15%
Voltage: 160V±8
Power: 1.7 mA
254 nm output: 260 uW/cm^2 (at surface)
Stability: 5 min
Life: 10000 hrs.

A lamp with these characteristics produces highly desirable results as shown in Table A.

TABLE A

| Kill rate (uW · sec/cm^2) | | Time to kill at 1 cm target distance (seconds) |
|---|---|---|
| *Escherichlia coli* | 6600 | 1.6 |
| *Staphylococcus aureus* | 6600 | 1.6 |
| *Streptococcus lactis* | 8800 | 2.2 |
| Infectious hepatitis | 8000 | 2.0 |
| Influenza | 6600 | 1.6 |

The present invention provides for a pen-like make-up brush device which is streamlined, lightweight, and accommodates interchangeable brush tips. The brush bristles are held in a shank. The shank, in turn, is connected to the mandrel by means of an appropriate quick connect means. The present invention is contemplated as being usable for all make-up applications. These would include, but would not be limited to, lip brush, concealer, eye shading, eyeliner, lash brush, blush brush, and a brow brush. Because the brush tips are easily removed and changed, the user is able to both effectively clean the various brush tips, and to customize the device for specific/personalized use. The ultra violet light source with electronic board, battery source, and timer switch is placed in the cover and the base of the case such that when the case is closed the light comes on to sanitize the tip bristles. A timer switch is incorporated into the electronic board to keep the light sanitizing for five minutes while contained in the case. The light automatically switches off when sanitization is complete.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A make-up brush system, comprising:

an elongated mandrel shaped and dimensioned for handling by a make-up artist including a first end and a second end, the first end including a gripping surface for engagement with a hand of a make-up artist and the second end being shaped and dimensioned for selective engagement with a plurality of make-up brushes;

a plurality of make-up brushes, each of the plurality of make-up brushes including a first end and a second end, the first end including a functional component of the make-up brush and the second end including a coupling member shaped and dimensioned for selective engagement with the second end of the mandrel; and a case both supporting and sanitizing the plurality of make-up brushes and the mandrel, the case includes a power supply and an ultraviolet light providing for sanitizing the plurality of make-up brushes and the mandrel, the case also include a base and a cover, the base and cover are connected allowing for the cover to move between an open configuration where the contents of the case are exposed and a closed configuration where the contents of the case are fully enclosed within the case.

* * * * *